US009494357B2

(12) United States Patent
Kim et al.

(10) Patent No.: US 9,494,357 B2
(45) Date of Patent: Nov. 15, 2016

(54) ICE MAKER, REFRIGERATOR HAVING THE SAME, AND METHOD FOR SUPPLYING ICE THEREOF

(75) Inventors: Bongjin Kim, Seoul (KR); Seongjae Kim, Seoul (KR); Moongyo Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 527 days.

(21) Appl. No.: 13/580,388

(22) PCT Filed: Feb. 23, 2011

(86) PCT No.: PCT/KR2011/001237

§ 371 (c)(1),
(2), (4) Date: Aug. 22, 2012

(87) PCT Pub. No.: WO2011/105789

PCT Pub. Date: Sep. 1, 2011

(65) Prior Publication Data

US 2012/0318004 A1 Dec. 20, 2012

(30) Foreign Application Priority Data

Feb. 23, 2010 (KR) ..... 10-2010-0016374

(51) Int. Cl.
*F25C 1/00* (2006.01)
*F25C 1/04* (2006.01)
(Continued)

(52) U.S. Cl.
CPC . *F25C 1/04* (2013.01); *F25C 1/12* (2013.01); *F25C 5/04* (2013.01); *F25C 2400/10* (2013.01); *F25C 2600/04* (2013.01); *F25C 2700/12* (2013.01)

(58) Field of Classification Search
CPC ..... F25C 1/147; F25C 5/02; F25C 5/04; F25C 1/12
USPC ..... 62/344, 353, 75
See application file for complete search history.

(56) References Cited

U.S. PATENT DOCUMENTS 3,733,844 A * 5/1973 Turner ..... 62/320
3,861,163 A * 1/1975 Carpenter ..... 62/73
(Continued)

FOREIGN PATENT DOCUMENTS

CN 2105026 U 5/1992
CN 1347489 A 5/2002
(Continued)

OTHER PUBLICATIONS

International Search Report dated Feb. 23, 2011 for Application No. PCT/KR2011/001237, 2 pages.
(Continued)

*Primary Examiner* — Jonathan Bradford
*Assistant Examiner* — Melanie Phero
(74) *Attorney, Agent, or Firm* — Fish & Richardson P.C.

(57) ABSTRACT

Disclosed are an ice maker, a refrigerator having the ice maker, and a method for supplying ice of the refrigerator. An ice making container long in a vertical direction is installed on a side wall surface of a refrigerator door, makes ice, and pushes up the ice by screws to release the ice, whereby the size of the ice maker can be reduced, the area occupied by the ice maker can be reduced, and a refrigerator having the ice maker can become slimmer. Also, because an installation height of the ice maker is lowered to shorten a cold air supply path and prevent a loss in the process of supplying cold air to the ice making chamber. Also, because a cutting operation is performed simultaneously when the ice is lifted, a fabrication cost can be reduced and a defective state due to malfunction can be prevented.

13 Claims, 8 Drawing Sheets

(51) Int. Cl.
*F25C 5/04* (2006.01)
*F25C 1/12* (2006.01)

(56) References Cited

U.S. PATENT DOCUMENTS

| | | | | |
|---|---|---|---|---|
| 3,896,631 | A | 7/1975 | Morrison | |
| 3,984,996 | A | 10/1976 | Bright | |
| 4,198,831 | A * | 4/1980 | Barnard et al. | 62/320 |
| 4,467,622 | A | 8/1984 | Takahashi et al. | |
| 4,539,750 | A | 9/1985 | Jarvi et al. | |
| 6,082,121 | A * | 7/2000 | Marsh et al. | 62/75 |
| 8,528,356 | B2 * | 9/2013 | Junge et al. | 62/320 |
| 8,627,679 | B2 * | 1/2014 | Anselmino et al. | 62/344 |
| 2004/0237565 | A1 | 12/2004 | Lee et al. | |
| 2009/0145142 | A1 * | 6/2009 | Lanzani | 62/137 |
| 2009/0151373 | A1 * | 6/2009 | Lee et al. | 62/137 |
| 2009/0217692 | A1 * | 9/2009 | Kim et al. | 62/346 |

FOREIGN PATENT DOCUMENTS

| | | | |
|---|---|---|---|
| CN | 1924490 | A | 3/2007 |
| EP | 2 056 047 | A1 | 5/2009 |
| GB | 695696 | | 8/1953 |
| JP | 05-240542 | A | 9/1993 |
| KR | 10-0246392 | B1 | 4/2000 |
| KR | 10-2003-0069462 | A | 8/2003 |
| KR | 10-0547342 | | 1/2006 |
| WO | WO 01/27544 | A2 | 4/2001 |
| WO | 2008/130115 | | 10/2008 |

OTHER PUBLICATIONS

Extended European Search Report issued in European Application No. 11747679.6 on Jan. 15, 2016, 11 pages.

* cited by examiner

ICE MAKER, REFRIGERATOR HAVING THE SAME, AND METHOD FOR SUPPLYING ICE THEREOF

CROSS REFERENCE TO RELATED APPLICATIONS

This application is a U.S. National Phase Application under 35 U.S.C. §371 of International Application PCT/KR2011/001237, filed on Feb. 23, 2011, which claims the benefit of Korean Application No. 10-2010-0016374, filed on Feb. 23, 2010, the entire content of each application is hereby incorporated by reference.

TECHNICAL FIELD

The present invention relates to an ice maker, a refrigerator having the same, and a method for supplying ice of the refrigerator and, more particularly, to an ice maker having a small occupancy area and high space utilization, a refrigerator having the same, and a method for supplying ice of the refrigerator.

BACKGROUND ART

In general, a household refrigerator is a device having a certain accommodation space to keep food items, or the like, at a low temperature, which is divided into a refrigerating chamber maintained above zero in a low temperature range and a freezing chamber maintained below zero in the low temperature range. Recently, as demand for ice rises, refrigerators having an automatic ice maker making ice are increasing.

The automatic ice maker (referred to as an ice maker, hereinafter) may be installed in the freezing chamber or in the refrigerating chamber according to the types of refrigerators. When the ice maker is installed in the refrigerating chamber, cold air in the freezing chamber is guided (or provided) to the ice maker to make ice.

Ice makers may be divided into a twist type icemaker, an ejector type icemaker, and a rotation type ice maker depending on how ice made by the ice maker is released. The twist type ice maker releases ice by twisting an ice making container. The ejector type ice maker draws up to release ice from the ice container by an ejector installed at an upper side of the ice making container. The rotation type ice maker releases ice from the ice making container by rotating the ice making container.

DISCLOSURE OF INVENTION

Technical Problem

However, the related ice makers have the following problems.

First, the related art ice maker makes ice with water put in a generally horizontal ice making container, the ice making container occupies a large area and an ice releasing unit for releasing ice from the ice making container is voluminous to reduce an available space of the refrigerator overall. In particular, the related art ice maker is horizontally installed on a refrigerator door, further reducing the available space of the refrigerator. In this case, if the size of the ice maker is reduced, the amount of ice to be made is reduced as much, failing to provide ice quickly when a large amount of ice is required in the summer season.

Second, the ice making container of the related art ice maker is shallow, so when the refrigerator door is open or closed, water put in the ice making container overflows toward an ice storage container, making ice cubes in the ice storage container become entangled.

Third, in the related art ice maker, generally, ice is dropped so as to be stored or supplied, so in case of a refrigerator having a dispenser, the ice making chamber must be disposed to be higher than the dispenser. However, in a 3-door bottom freezer type refrigerator in which a freezing chamber is disposed at a lower side and a refrigerating chamber having an ice maker is disposed at an upper side, when the ice making chamber is disposed to be high, the ice making chamber becomes distant from the freezing chamber, so generating a loss of cold air when cold air from the freezing chamber is delivered to the ice making chamber and reducing energy efficiency of the refrigerator.

Fourth, in the related art ice maker, an ice making unit and an ice releasing unit are operated by independent mechanisms, complicating the configuration and controlling and increasing the fabrication cost.

Solution to Problem

Therefore, an object of the present invention is to provide an ice maker occupying a small area to make a refrigerator thin, a refrigerator having the same, and an ice providing method of the refrigerator.

Another object of the present invention is to provide an ice maker capable of preventing water from overflowing from an ice making container and thus prevent ice cubes in an ice storage container from being entangled when a refrigerator door is open and closed, a refrigerator having the same, and an ice providing method of the refrigerator.

Another object of the present invention is to provide an ice maker installed at a relatively lower side to reduce the distance between an ice making chamber and a freezing chamber and prevent a loss of cold air when cold air is supplied from the freezing chamber to the ice making chamber, a refrigerator having the same, and an ice providing method of the refrigerator.

Another object of the present invention is to provide an ice maker which has a simple configuration and is easily controlled in operation to thus reduce a fabrication cost and prevent malfunction, a refrigerator having the same, and an ice providing method of the refrigerator.

To achieve these and other advantages and in accordance with the purpose of the present invention, as embodied and broadly described herein, there is provided an ice maker including: an ice making container for making ice; a lifting unit for lifting ice made in the ice making container; a cutting unit provided at an upper end of the ice making container and performing cutting to separate upper ice of ice lifted by the lifting unit from lower ice kept in the ice making container; and an ice storage container for storing ice cut by the cutting unit, wherein the storage container is disposed such that its upper end is lower than a lower end of the ice making container.

To achieve the above objects, there is also provided a refrigerator including: a refrigerator body having a receiving space; a refrigerator door coupled to the refrigerator door and opening and closing the receiving space; a lifting unit for lifting ice made in the ice making container; a cutting unit provided at an upper end of the ice making container and performing cutting to separate upper ice of ice lifted by the lifting unit from lower ice kept in the ice making container; and an ice storage container for storing ice cut by the cutting unit, wherein the storage container is disposed such that its upper end is lower than a lower end of the ice making container.

To achieve the above objects, there is also provided an ice supplying method including: making ice in an ice making container; receiving an ice dispense signal from a user; lifting ice of an ice making container; cutting the ice lifted from the ice making container; and dispensing the cut ice.

In the ice maker, the refrigerator having the same, and the method for supplying ice of the refrigerator according to exemplary embodiments of the present invention, the vertically long ice making container is installed on the side wall of the refrigerator door, water is supplied to the ice making container and frozen, and ice in the ice making container is pushed up by a screw so as to be released, whereby the size of the ice maker can be reduced, the area occupied by the ice maker can be reduced, and refrigerator having the ice maker can become slimmer.

In addition, the ice maker is configured such that ice can be released from an upper side, so the installation height of the ice maker can be lowered, and accordingly, a cold air supply path can be shortened to prevent a loss of cold air in the course of being supplied to the ice making chamber.

Also, with the ice maker, since ice is cut shortly after it is released upon being pushed up by using a screw, the configuration and operation controlling of the ice maker can be simplified, and accordingly, a fabrication cost can be reduced and malfunction can be prevented.

The foregoing and other objects, features, aspects and advantages of the present invention will become more apparent from the following detailed description of the present invention when taken in conjunction with the accompanying drawings.

Advantageous Effects of Invention

Disclosed are an ice maker, a refrigerator having the ice maker, and a method for supplying ice of the refrigerator. An ice making container long in a vertical direction is installed on a side wall surface of a refrigerator door, makes ice, and pushes up the ice by screws to release the ice, whereby the size of the ice maker can be reduced, the area occupied by the ice maker can be reduced, and a refrigerator having the ice maker can become slimmer. Also, because an installation height of the ice maker is lowered to shorten a cold air supply path and prevent a loss in the process of supplying cold air to the ice making chamber. Also, because a cutting operation is performed simultaneously when the ice is lifted, a fabrication cost can be reduced and a defective state due to malfunction can be prevented.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

An ice maker, a refrigerator having the same, and a method for supplying ice of the refrigerator according to exemplary embodiments of the present invention will be described in detail with reference to the accompanying drawings.

Figure 1:
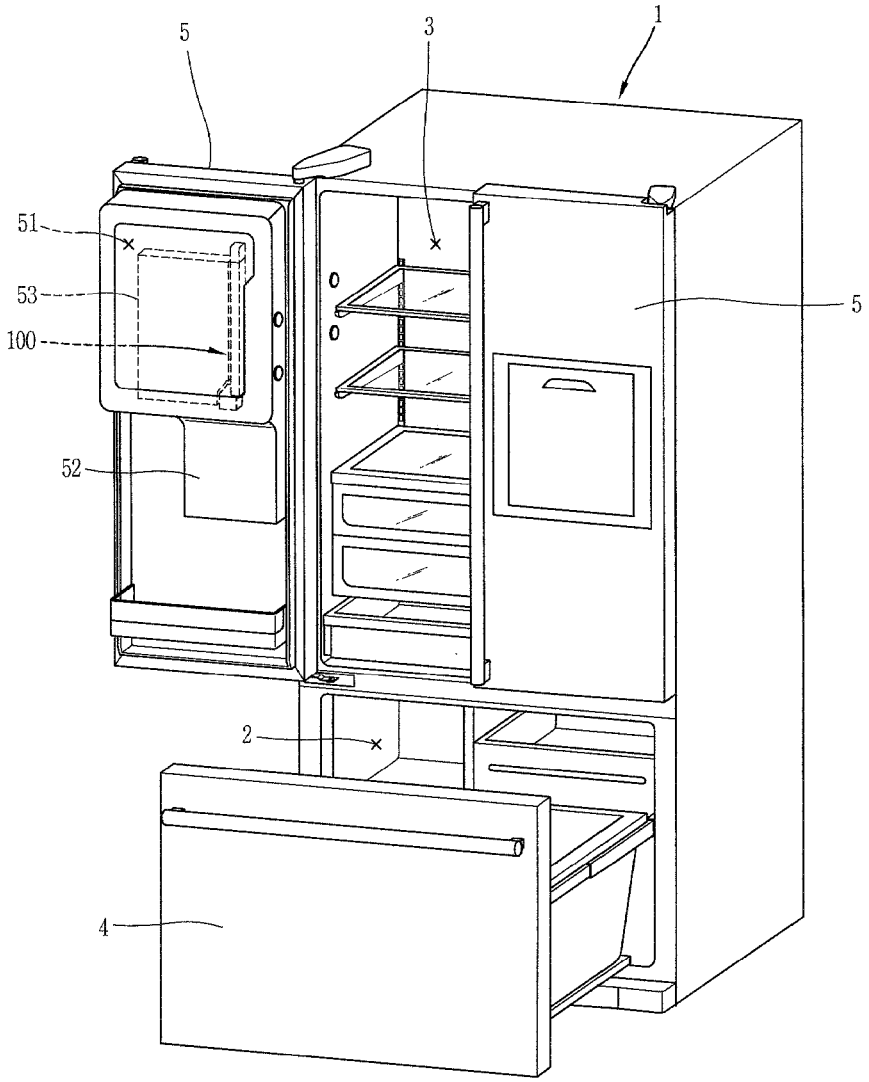
FIG. 1 is a bottom freezer type refrigerator having an ice maker according to an exemplary embodiment of the present invention.
Figure 2:
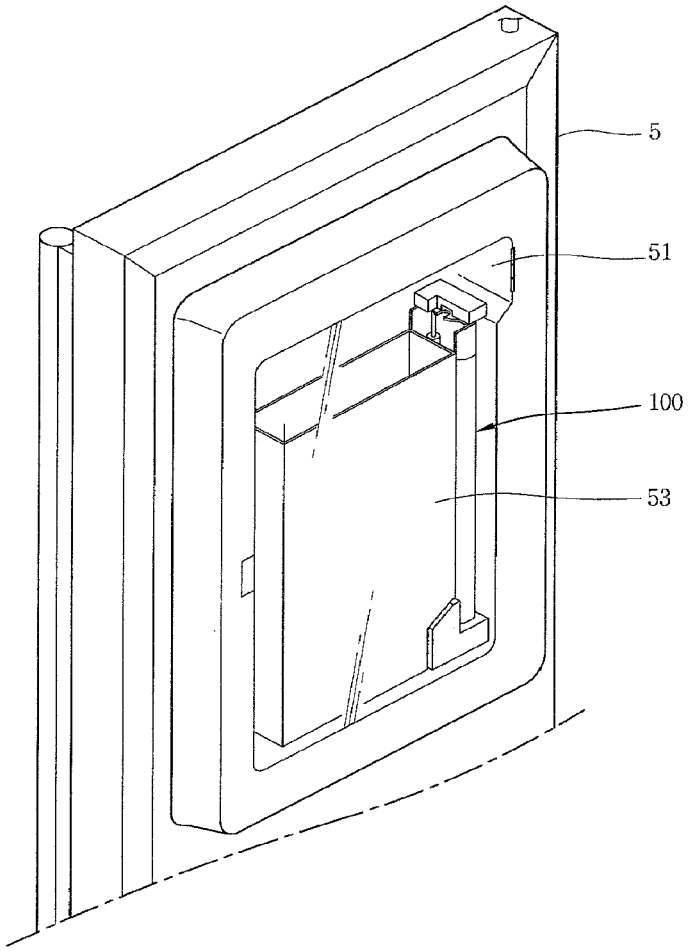
FIG. 2 is a perspective view showing a refrigerator door having the ice maker in FIG. 1 according to an exemplary embodiment of the present invention.

FIG. 1 is a bottom freezer type refrigerator having an ice maker according to an exemplary embodiment of the present invention, and FIG. 2 is a perspective view showing a refrigerator door having the ice maker in FIG. 1 according to an exemplary embodiment of the present invention.

As shown in FIGS. 1 and 2, a refrigerator according to an exemplary embodiment of the present invention includes a freezing chamber 2 formed at a lower portion of a refrigerator body 1 and keeping food items in storage in a frozen state and a refrigerating chamber 3 formed at an upper portion of the refrigerator body 1 and keeping food items in storage in a refrigerated state. A freezing chamber door 4 and is installed at the freezing chamber 2 to open and close the freezing chamber 2 in a drawer manner, and a plurality of refrigerating chamber doors 5 are installed at both sides of the refrigerating chamber 3 in order to open and close the refrigerating chamber 3 at both sides in a hinged manner. A mechanic chamber is formed at a lower end of a rear side of the refrigerator body 1, in which a compressor and a condenser are installed.

An evaporator (not shown) connected with the condenser and the compressor to supply cold air to the freezing chamber 2 or to the refrigerating chamber 3 may be installed on the rear surface of the refrigerator body 1, namely, on the rear wall surface of the freezing chamber 2 between an outer case and an inner case. Also, the evaporator may be insertedly installed at an inner side of a side wall surface or an upper wall surface of the freezing chamber 2 or may be insertedly positioned at an inner side of a barrier demarcating the freezing chamber 2 and the refrigerating chamber 3. A single evaporator may be installed in the freezing chamber 2 to distributedly supply cold air to the freezing chamber 2 and the refrigerating chamber 3, or a freezing chamber evaporator and a refrigerating chamber evaporator may be installed, respectively, to independently supply cold air to the freezing chamber 2 and the refrigerating chamber 3.

An ice making chamber 51 is formed on an inner wall surface of an upper portion of the refrigerating chamber door 5 in order to make and keep ice, and an ice maker 100 for making ice is installed in the interior of the ice maker 51. A dispenser 52 is installed to be exposed from the refrigerator to allow ice made in the ice maker 100 to be drawn out of the refrigerator.

In the refrigerator according to an exemplary embodiment of the present invention as described above, when a load in the freezing chamber 2 or the refrigerating chamber 3 is detected, the compressor operates to generate cold air from the evaporator, and a portion of the cold air is supplied to the freezing chamber 2 and the refrigerating chamber 3, and another portion of the cold air generated from the evaporator is supplied to the ice making chamber 51. The cold air supplied to the ice making chamber 51 is exchanged to allow the ice maker 100 mounted in the ice making chamber 51 to make ice and then retrieved to the freezing chamber 2 or supplied to the refrigerating chamber 3. The ice made in the ice maker 100 is taken out according to a request from the dispenser 52. This sequential process is repeatedly performed.

Figure 3:
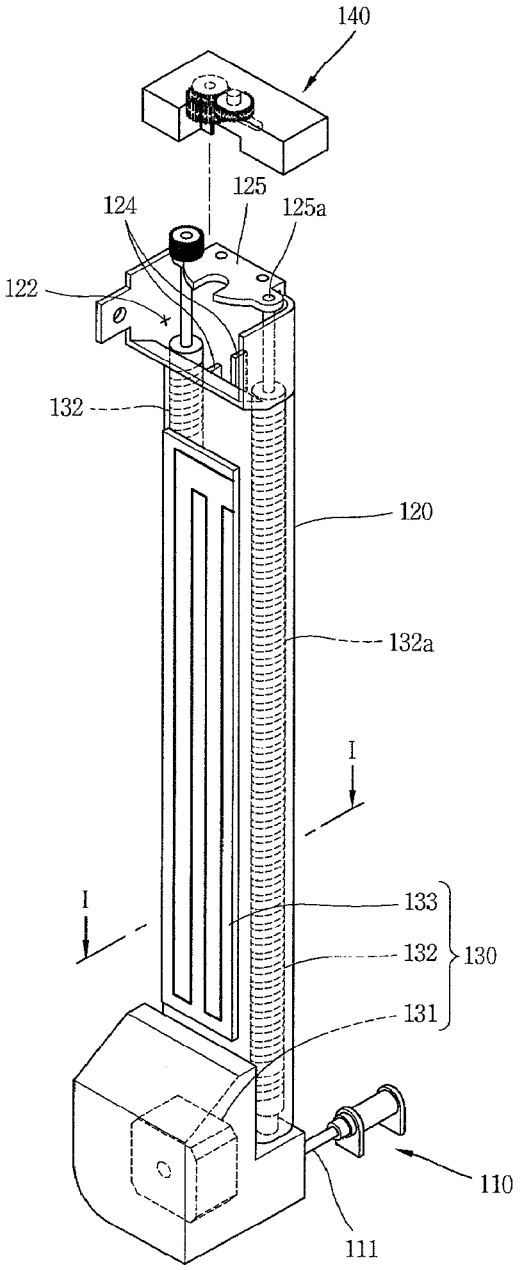
FIG. 3 is a perspective view of the ice maker in FIG. 2.
Figure 4:
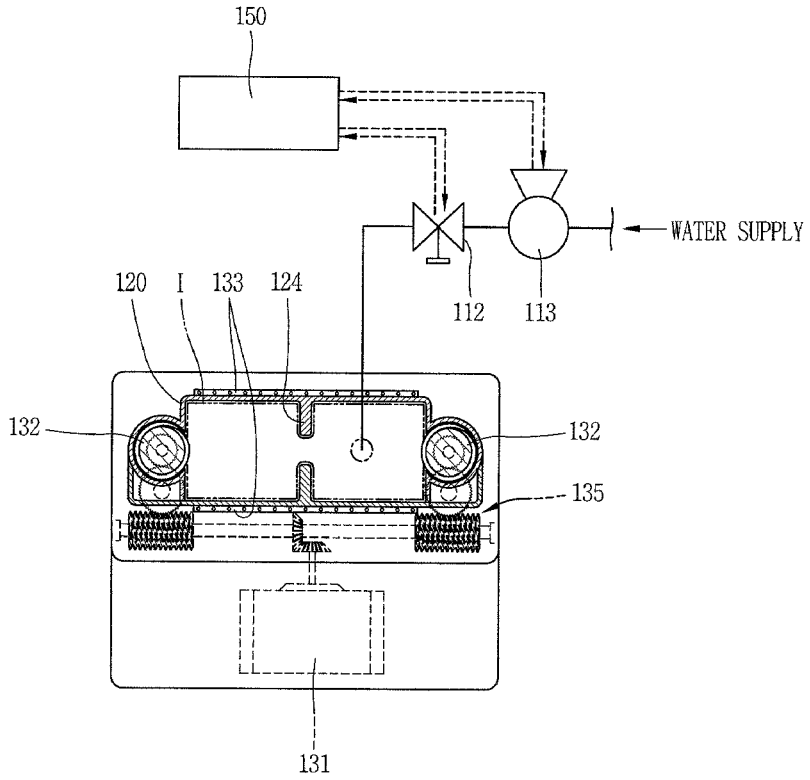
FIG. 4 is a sectional view taken along line I-I in FIG. 3.
Figure 5:
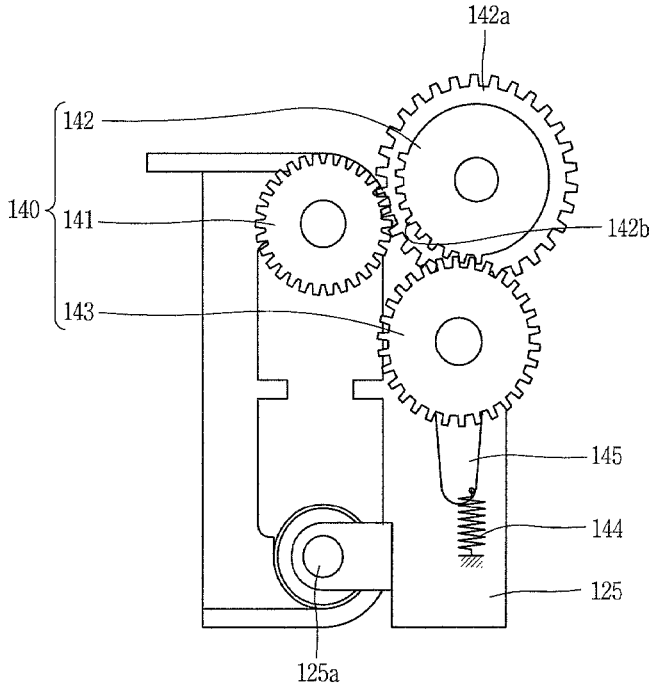
FIGS. 5 and 6 are plan views showing the operation of an example of a cutter unit of the ice maker in FIG. 2.
Figure 6:
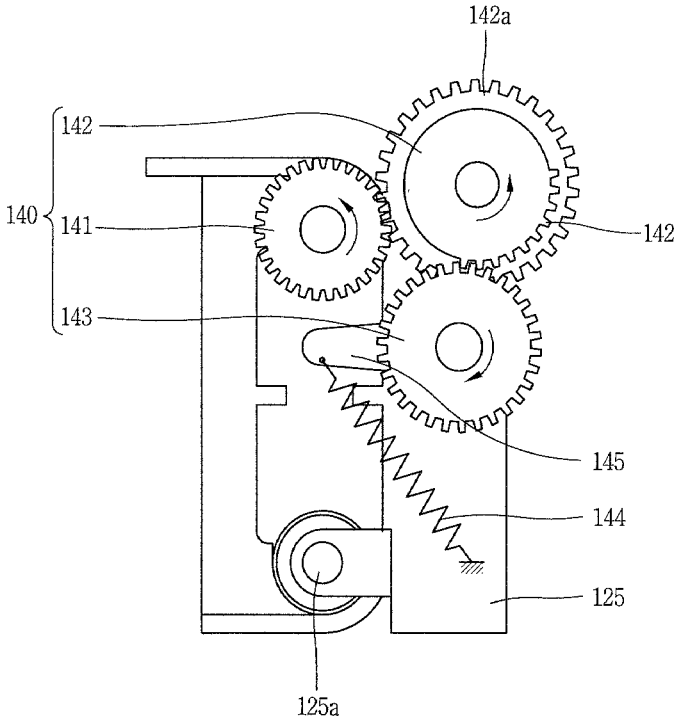
Figure 7:
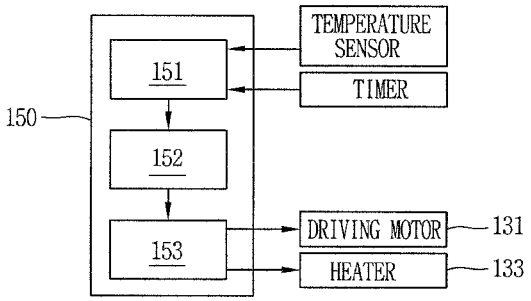
FIG. 7 is a schematic block diagram of a control unit in FIG. 4.

FIG. 3 is a perspective view of the ice maker in FIG. 2, FIG. 4 is a sectional view taken along line I-I in FIG. 3, FIGS. 5 and 6 are plan views showing the operation of an example of a cutter unit of the ice maker in FIG. 2, and FIG. 7 is a schematic block diagram of a control unit in FIG. 4.

As shown in FIGS. 3 and 4, the ice maker 100 includes a water supply unit 110 connected to a water source and supplying water, an ice making container 120 for receiving water supplied from the water source 110 and making ice, a lifting unit 130 for lifting ice made in the ice making container 120 to release it, and a cutting unit 140 installed at an opening end of the ice making container 120, cutting ice (I) released from the ice making container 120 to allow the ice can be moved to a dispenser.

The water supply unit 110 includes a water supply pipe 111 connecting the water source and the ice making container 120, a water supply valve 112 installed in the middle of the water supply pipe 111 to regulate the amount of water supplied (or a water supply amount), and a water supply pump installed at an upper flow side or a lower flow side of the water supply valve 112 to pump water. Here, the water supply pump 113 is required to supply uniform water pressure, but not requisite. When the water supply pump 113 is excluded, water may be supplied by using a height difference between the water source and the ice making container 120.

The water supply pipe 111 may be directly connected to the water source to supply water, or the water supply pipe 111 may be connected to a water tank (not shown) provided in the refrigerating chamber 3 and storing a certain amount of water therein. In this case, the water tank is a water source. Here, in order to supply an appropriate amount of water to the ice making container 120, a water level sensor may be installed in the ice making container 120 or a flow sensor for detecting the amount of water flow may be installed in the water supply pipe or a water level sensor may be installed in the water tank.

The water supply valve 112 and the water supply pump 113 may be electrically connected to transmit and receive a signal to a control unit. The control unit 150 may regulate the water supply amount based on a value detected in real time by the water level sensor or the flow sensor, or an operation time of the water supply valve 112 and the water supply pump 113 may be made into data so as to periodically turn on or off the water supply valve 112 and the water supply pump 113.

As shown in FIG. 2, the ice making container 120 includes an ice making space 121 therein. Preferably, the ice making container 120 is installed at one wall surface, namely, a left wall surface or a right wall surface (the right side when inwardly projected in FIG. 2), of the refrigerating chamber door 3 in order to reduce the area occupied by the ice maker 100.

A driving unit 131 (to be described) is coupled and sealed to a lower end of the ice making container 120 to hermetically seal the ice making container 120, and an ice discharge hole 122 is formed at an upper end of the ice making container 120 to allow released ice cubes to be discharged to the ice storage container 53. The ice discharge hole 122 is formed at a front side of the ice making container 120 so that ice can be discharged in a horizontal direction of the refrigerating chamber door 3 and guided to the ice storage container 53 installed at a central portion of the front side. Here, the ice storage container 53 is disposed such that its upper end is higher than a lower end of the ice making container 120. Preferably, the ice storage container 53 is positioned to be as high as the ice discharge hole 122.

The ice making container may be made of a heat conductive material such as aluminum and may have a shape of a rectangular section having a certain thickness. Of course, the ice making container 120 may have various shapes as necessary. In this case, since ice needs to be in contact with one or two screws (which are installed at left and right sides of the ice making container) (to be described), the ice making container 120 may be formed to have a horizontally long rectangular shape to make ice of rectangular parallelepiped.

The ice making container 120 may include ribs 124 formed on an inner circumferential surface. Namely, ice made in the ice making container 120 is a sort of a lump of bulky ice, so it is not easy to cut the lump of ice with a cutter or cut ice cubes may not be uniform. Thus, the ribs 124 may be formed to be long in a vertical direction on an inner circumferential surface of the ice making container 120 in order to demarcate ice lifted by the lifting unit 130 at certain intervals in a horizontal direction as possible. The shape of the pieces of ice may be determined according to the shape of the ribs 124.

The ice making container 120 may be formed to have the same sectional area and shape in a lengthwise direction, or may be formed to have a different sectional area and shape along the lengthwise direction as necessary. When the ice making container 120 has a different sectional area and shape in the lengthwise direction, the ice making container 120 may be formed to widen toward an opening end, i.e., an ice releasing end, to allow ice made in the ice making container to be smoothly released along the lengthwise direction.

A screw bracket 125 is formed at an upper end of the ice discharge hole 122 in order to rotatably support a screw 132 of the lifting unit 130 (to be described), and a plurality of support holes **125*a* are formed on left and right portions of the screw bracket 125 to allow the screw 132** to be rotatably coupled therein.

A single ice making container 120 may be provided or a plurality of ice making containers 120 may be provided according to the capacity or ice making capacity of a refrigerator or according to circumstances. When a plurality of ice making containers 120 are provided, they may be arranged in a row or may be arranged in double rows in consideration of the relationships with ambient components. When the ice making containers are arranged in double rows, since the ice discharge hole is formed at a front side of the ice making containers, the ice making container in a rear row may be formed to be higher than the ice making container in a front row in order to allow ice discharged from the ice making container in the rear row to smoothly pass over the ice making container in the front row so as to be guided to the ice storage container. Besides, the arrangement of the ice making containers 120 may be appropriately adjusted.

The lifting unit 130 includes a driving motor 131 coupled to a lower end of the ice making container 120 and generating a driving force (or power) to release ice, a plurality of screws 132 coupled to the driving motor 131 and pushing up ice while being rotated, and a heater 133 provided at an outer surface of the ice making container 120 to melt the interface between the ice and the ice making container to release ice.

The driving motor 131 is configured as a uni-directional rotary motor, and a decelerator 135 may be coupled to a rotational shaft of the driving motor 131 in order to appropriately decelerate a turning force of the driving motor 131 and deliver the decelerated force to the screw 132.

The screws 132 are formed to be long in a vertical direction. An upper end of each of the screws 132 is rotatably coupled to the screw bracket 125 of the ice making container 120, and a lower end thereof is coupled to a rotational shaft (not shown) of the driving motor 131 with the decelerator 135 interposed therebetween.

The screws 132 have thread portion 132*a* which are in contact with the ice (I) up to a certain height of the ice making container 120 to push up the ice (I). The thread portion 132*a* may have a shape of a triangular section or other shapes such as a shape of a square section.

The screws 132 may be installed at left and right sides of the ice making container 120, or a single screw 132 may be installed at the center of the ice making container 120 according to circumstances.

As shown in FIG. 3, the heater 133 may be configured as a line heater (or a thermal line) wound to be brought into contact with a front surface of the ice making container 120. In this case, the heater 133 may be configured as a single circuit according to the configuration of the ice making container 120, or may include a plurality of circuits according to circumstances.

The heater 133 may be controlled to interwork with the water supply unit 110. For example, it is determined whether water is being currently supplied to the ice making container 120 to make ice, whether ice making is being performed, or whether ice, after being made, is being released according to the change in the values detected by the water level sensor or the flow sensor, and when it is determined that water is being supplied to make ice or when it is determined that water has been completely supplied and ice is being currently made, the operation of the heater is stopped, and when ice releasing is currently performed after ice making is completed, the operation of the heater 133 may be controlled to start.

Here, a point in time at which the heater 133 is operated may be determined by detecting the temperature of the ice making container 120 in real time or periodically, or a time which has lapsed after the value of the water level sensor or the flow sensor of the water supply unit 110 was changed may be made into data and the heater may be forcibly operated according to the data value. Namely, whether or not the ice making operation has been completed can be checked by detecting the temperature of the ice making container 120 or through an ice making time. For example, when the temperature measured by a temperature sensor (not shown) mounted in the ice making container 120 is lower than a certain temperature, e.g., −9 C, it may be determined that ice making has been completed, or when a certain time has lapsed after water was supplied, it may be determined that ice making has been completed.

Although not shown, the heater 133 may be formed of a conductive polymer, a plate heater with positive thermal coefficient, an aluminum thin film, and other materials such as a heat transfer available material, or the like.

Except for that the heater is attached to the front side of the ice making container 120, although not shown, it may be buried in the interior of the ice making container 120 or provided on an inner circumferential surface of the ice making container 120. Also, without using the heater 133, the ice making container may be configured as a resistor which can generate heat such that at least a portion of the ice making container 120 may serve as a heater to generate heat when electricity is applied thereto.

The heater 133 may be installed to be spaced apart from the ice making container 120, rather than being in contact with the ice making container 120, so as to be configured as a heat source. For example, the heat source includes a light source irradiating light to at least one of ice and the ice making container 120, a magnetron irradiating microwaves to at least one of ice and the ice making container 120. The heat sources such as the heater, the light source, or the magnetron directly applies thermal energy to at least one of ice and the ice making container 120 or to the interface therebetween to melt a portion of the interface between ice and the ice making container 120. Accordingly, when the screw 132 operate, although the interface between the ice and the ice making container 120 is not entirely thawed, the ice can be separated from the ice making container by the screws 132.

As shown in FIGS. 5 and 6, the cutting unit 140 includes a driving gear 141 coupled to the screws 132, an intermediate gear 142 whose rotating speed is adjusted by being rotated in mesh with the driving gear 141, and a following gear 143 rotated in mesh with the intermediate gear 142 and having a cutter blade 145 to cut ice.

The intermediate gear 142 may include a first gear portion 142*a* in mesh with the driving gear 141 and a second gear portion 142*b* in mesh with the following gear 142. The second gear portion 142*b* of the intermediate gear 142 is formed only at a portion of the intermediate gear 142 along a circumferential direction in order to curb the following gear 143 only at the portion, and other portions of the intermediate gear 142 which are not in mesh with the following gear 143 may be elastically supported by an elastic member 144 to allow the following gear 143 to return to a cutting preparation position.

Meanwhile, the driving motor 131 and the heater 133 may be controlled together by a control unit 150, namely, a microcomputer, electrically connected to the driving motor 131 and the heater 133. For example, as shown in FIG. 7, the control unit 150 includes a detection unit 151 connected to a temperature sensor (not shown) to detect the temperature of the ice making container 120 or a timer (not shown) to detect a time which has lapsed since water was supplied, a determining unit 152 for determining whether or not ice making has been completed by comparing the temperature or time detected by the detection unit 151 with a reference value, and a command unit 153 for controlling an ON/OFF operation of the heater 133 and the operation of the driving motor 131 according to the determination of the determining unit 152.

Figure 8:
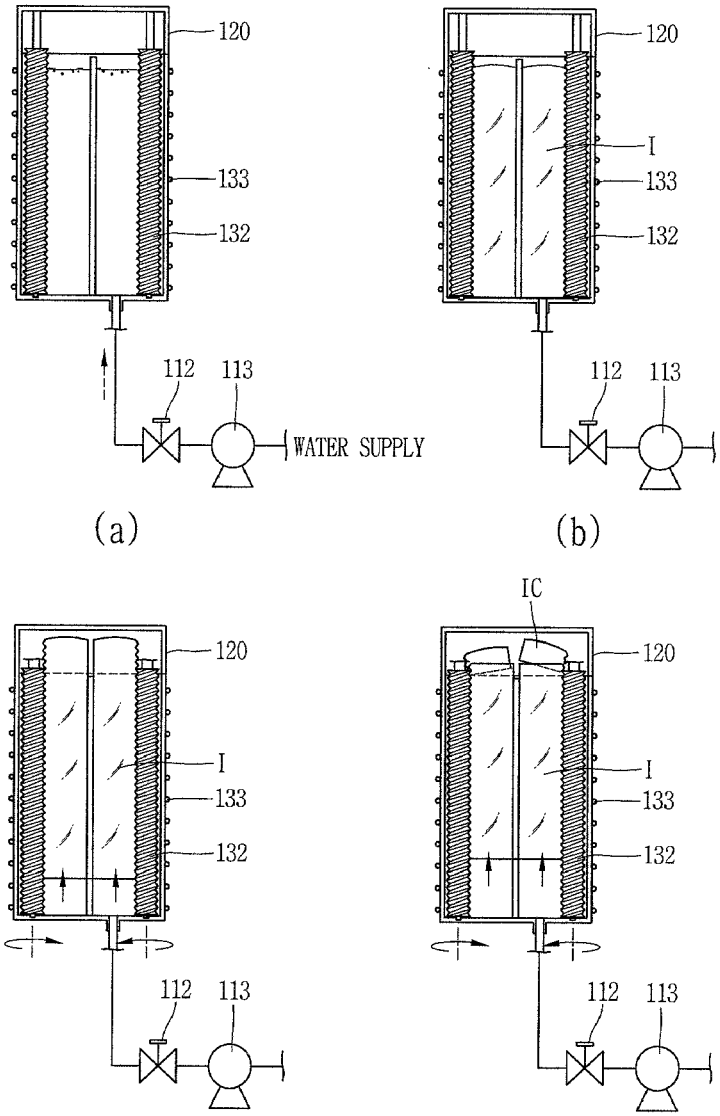
FIG. 8 is a vertical sectional view showing an ice making process of the ice maker in FIG. 3.
Figure 9:
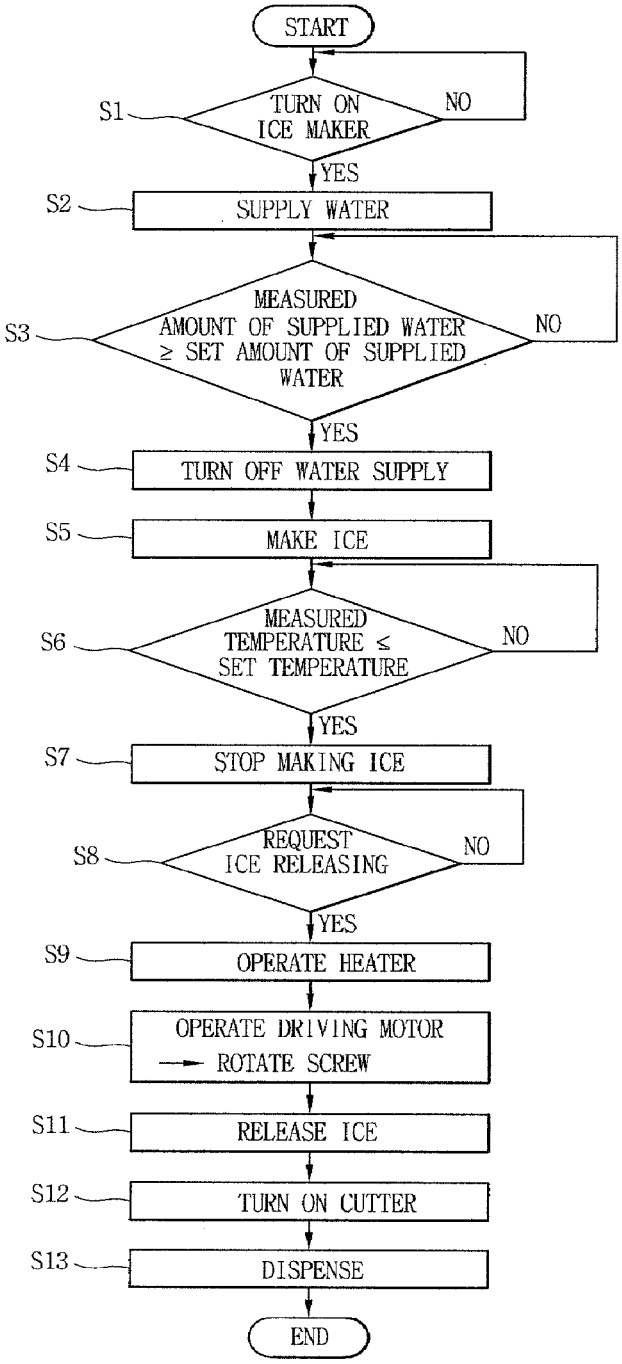
FIG. 9 is a flow chart illustrating the ice making process performed by the ice maker in FIG. 3.

An ice supply method in a refrigerator according to an exemplary embodiment of the present invention is shown in FIGS. 8 and 9.

As illustrated, when ice making is required, the ice maker 100 is turned on to start ice making operation (S1). Then, the water supply unit 110 supplies water to the ice making container 120 (S2). In this case, the water supply amount is detected by using the water level sensor installed at the ice making container 120, the flow sensor installed at the water supply pipe, the water level sensor installed at the water tank, and the like, in real time, and the detected water supply amount is delivered to the microcomputer. Then, the microcomputer compares the received water supply amount with a pre-set water supply amount (S3). The microcomputer determines whether or not an appropriate amount of water has been supplied to the ice making container 120 according to the comparison, and when the microcomputer determines that an appropriate amount of water has been supplied to the ice making container 120, the microcomputer shuts off the water supply valve of the water supply unit 110 to prevent water from being supplied to the ice making container any more (S4).

When the water supply to the ice making container 120 is completed, the water in the ice making container 120 is exposed to cold air supplied to the ice making chamber 51 for more than a certain period of time and frozen (S5). While the water in the ice making container 120 is being frozen, the temperature sensor (not shown) detects the temperature of the ice making container periodically or in real time and delivers the detected temperature to the microcomputer. The microcomputer compares the received measured temperature with a pre-set temperature (S6). The microcomputer determines whether the surface of the water put in the ice making container 110 has been frozen, and when the microcomputer determines that the surface of the water in the ice making container 110 has been frozen, it stops the sequential operations and enters a water releasing step (S7).

When ice dispensing is requested by the user, the heater 133 is operated by the control unit 150, and when the heater 133 is operated, heat is applied to the ice making container 120, melting an outer surface of the ice in contact with the inner circumferential surface of the ice making container 120.

Thereafter, when the driving motor 131 is operated by the control unit 150, the both screws 132 are rotated, and the thread portion 132*a* of the screws 132 pushes up ice to perform ice releasing (S9 to S11).

Next, when the screws 132 are rotated, the cutting unit 140 coupled to the upper end of the screws 132 are operated. Namely, the driving gear 141 and the intermediate gear 142 coupled to the upper end of the screw 132 rotate and the following gear 143 in mesh with a portion of the intermediate gear 142 to rotate. Then, the cutter blade 145 of the following gear 143 cuts lifted ice (S12). When the intermediate gear 142 further rotates so the following gear 143 escapes the second gear portion 142*b* of the intermediate gear 142, the following gear 143 returns to its original position by the elastic member 144. An Ice cube IC cut by the cutting unit 140 freefalls through the ice discharge hole 122 and is directly discharged to the dispenser 52 or discharged to the ice storage container 53 disposed at the front side of the ice making container (S13).

Here, in the process of releasing ice from the ice making container 120 or in the process of preparing ice releasing, supply of cold air to the ice making chamber 51 may be stopped to facilitate the ice releasing operation and reduce power applied to the heater 133.

When dispensing is completed, the operations of the heater 133 and the cutting unit 140 are stopped, the water supply valve 112 is open to supply an appropriate amount of water to the ice making container 120 by the water level sensor, the flow sensor, or the like. This sequential process is repeatedly performed.

In this manner, because the size of the ice maker is reduced to be as small as to be installed on the side wall surface of the refrigerator door, the area to be occupied by the ice maker can be reduced, and accordingly, the refrigerator including the ice maker can become slimmer. Namely, in the related art, the width of ice making container is large, and the width of the ice releasing unit for releasing ice from the ice making container is large, increasing the width of the ice maker overall to have a limitation of making the refrigerator including the same slimmer, but in the present invention, because the ice maker includes an ice making container having a small diameter and is installed to be long in the vertical direction on one wall surface of the refrigerator door, the area occupied by the ice maker overall can be significantly reduced.

Also, since the installation height of the ice maker is lowered, a cold air supply path can be shortened, and accordingly, the loss of cold air when it is supplied to the ice making chamber through the supply path can be prevented. Namely, in the related art, the ice storage container for keeping ice made in the ice making container in storage is installed at a lower side of the ice making container, but in the present invention, the vertically long ice making container is applied and keeps a certain amount of ice, so any additional ice storage container can be omitted. Even when an ice storage container is provided, it can be provided at the front side of the ice maker, the height of the ice maker can be lowered overall, and accordingly, the distance between the freezing chamber and the ice making chamber can be reduced, shortening the cold air supply path to reduce the loss of cold air and an input loss for driving the ice maker.

In addition, the configuration and operation controlling of the ice maker can be simplified to reduce a fabrication cost and prevent malfunction of the ice maker. Namely, in the related art, the twisting method, the heating method, the rotating method are applied to release ice, but in the present invention, since ice can be mechanically pushed up by using the rotational force of the driving motor and released, the configuration and operation controlling of the ice maker can be simplified and performed accurately, the fabrication cost of the ice maker can be reduced and defective ice making due to malfunction of the ice maker can be prevented, thus enhancing reliability of the ice maker.

A method for cutting ice in the ice maker of the refrigerator according to a different exemplary embodiment of the present invention will now be described.

In the former exemplary embodiment, the gear-type cutting blade is provided to the upper end of the ice making container, but in the present exemplary embodiment, a structure is installed in a proceeding direction of ice lifted in the ice making container to press and split ice, without providing the cutting blade.

Figure 10:
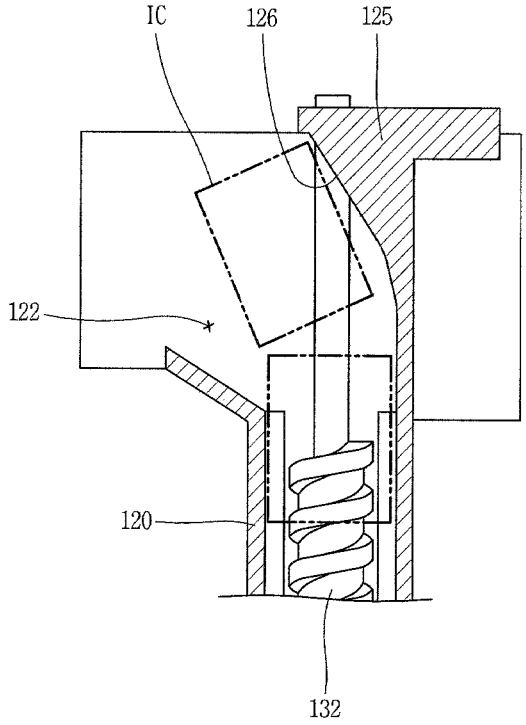
FIG. 10 is a schematic view showing another example of a cutter unit of the ice maker in FIG. 3.

For example, as shown in FIG. 10, a cutting face 126 is formed to be sloped on the bottom of a screw bracket 125 provided at an upper end of the ice making container 120, such that it goes crisscross to the ice lifting direction. When the ice is lifted by the screw 132, the upper end of the ice is blocked to be split by the cutting face 126, and the ice is guided to the dispenser 52 or to the ice storage container 53 through the ice discharge hole 122. In this case, the basic constitution and effects are the same as or similar to those of the foregoing exemplary embodiment, so a detailed description thereof will be omitted. In this case, however, when a cutting blade is not provided, the number of components is reduced, so the fabrication cost is reduced and the input of the driving motor is also reduced, enhancing the efficiency of the refrigerator.

The ice maker, the refrigerator having the ice maker, and the method for supplying ice of the refrigerator can be applicable to any freezing devices having an ice maker of a refrigerator having two clamshell doors.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A refrigerator comprising:

a refrigerator body having a freezing chamber formed at a lower portion of the refrigerator body and a refrigerating chamber formed at an upper portion of the refrigerator body;

a freezing chamber door configured to open and close the freezing chamber;

a refrigerating chamber door configured to open and close the refrigerating chamber;

a dispenser installed at the refrigerating chamber door; and an ice maker provided to the refrigerating chamber door and configured to make ice, wherein the ice maker includes:

an ice making container for making ice;

a lifting unit for lifting ice made in the ice making container, the lifting unit including a driving motor provided at a lower end of the ice making container;

a cutting unit provided at an upper end of the ice making container and performing cutting to separate ice lifted by the lifting unit, wherein the cutting unit is coupled to the lifting unit and cuts ice lifted in an ice making space, while being rotated along with the lifting unit, wherein the cutting unit includes:

a driving gear located at the upper end of the ice making container and coupled to the lifting unit, the driving gear being rotated based on contact with the lifting unit causing the driving gear to rotate, an intermediate gear configured to regulate a rotation speed while being rotated in mesh with the driving gear based on an outer circumferential surface of the driving gear contacting a first gear portion of the intermediate gear located on a first outer circumferential surface of the intermediate gear, and a following gear rotated in mesh with the intermediate gear based on a second outer circumferential surface of the intermediate gear contacting the following gear, the following gear having a cutting blade for cutting ice, wherein the intermediate gear includes a second gear portion located at the second outer circumferential surface of the intermediate gear and in mesh with the following gear, the second gear portion of the intermediate gear being located only at a portion of the second outer circumferential surface of the intermediate gear such that a remaining portion of the second outer circumferential surface of the intermediate gear is not in mesh with the following gear, wherein the following gear is elastically supported by an elastic member that allows the following gear to return to a cutting preparation position, and wherein the second gear portion of the intermediate gear rotates, in a first direction, the following gear from the cutting preparation position to cause the cutting blade of the following gear to cut ice lifted by the lifting unit and, based on rotation of the intermediate gear, relative to the following gear, reaching the remaining portion of the second outer circumferential surface of the intermediate gear that is not in mesh with the following gear, the elastic member rotates, in a second direction that is opposite of the first direction, the following gear to return the following gear to the cutting preparation position.

2. The refrigerator of claim 1, wherein the ice making container comprises at least one rib formed in a vertical direction on an inner circumferential surface of the longer axis direction.

3. The refrigerator of claim 1, wherein the lifting unit further comprises:

screws provided to be in contact with ice at both sides of the ice making container.

4. The refrigerator of claim 1, wherein the elastic member is is configured to allow arcuate motion of the cutting blade, and wherein a first end of the elastic member is fixed to a bracket supporting the lifting unit, and a second end of the elastic member is fixed to the cutting blade.

5. The refrigerator of claim 1, wherein the ice making container is made of a heat conductive material, and one or more heaters are provided to apply heat to the ice making container.

6. The refrigerator of claim 5, wherein the heater is electrically connected to a control unit that controls an ON/OFF operation of the heater, and the control unit comprises a detection unit for detecting the temperature of the ice making container or detecting a time which has lapsed since water was supplied, a determining unit for determining whether or not ice making has been completed by comparing the temperature or time detected by the detection unit with a reference value, and a command unit for controlling an ON/OFF operation of the heater according to the determination of the determining unit.

7. The refrigerator of claim 1, further comprising an ice storage container for storing ice cut by the cutting unit, wherein the ice making container is installed on a side wall surface of the refrigerating chamber door, and the ice storage container is installed at one side of the ice making container in a lateral direction of the refrigerating chamber door.

8. The refrigerator of claim 1, wherein the ice making container widens toward an opening end of the ice making container.

9. The refrigerator of claim 1, further comprising a decelerator that is coupled to a rotational shaft of the driving motor, that is located at the lower end of the ice making container, and that is configured to decelerate a turning force of the driving motor and deliver the decelerated force to the screws.

10. A refrigerator comprising:

a refrigerator body having a freezing chamber formed at a lower portion of the refrigerator body and a refrigerating chamber formed at an upper portion of the refrigerator body;

a freezing chamber door configured to open and close the freezing chamber;

a refrigerating chamber door configured to open and close the refrigerating chamber;

a dispenser installed at the refrigerating chamber door; and an ice maker provided to the refrigerator door and configured to make ice, wherein the ice maker includes:

an ice making container for making ice;

a lifting unit for lifting ice made in the ice making container, wherein the lifting unit includes:

screws provided at both sides of the ice making container; and a driving motor coupled to a lower end of the ice making container to rotate the screws;

a cutting unit provided at an upper end of the ice making container and performing cutting to separate ice lifted by the lifting unit; and an ice storage container for storing ice cut by the cutting unit, wherein the cutting unit is coupled to one of the screws and cuts ice lifted in the ice making space while being rotated along with the screws, wherein the cutting unit includes an intermediate gear rotated with the one of the screws, and a following gear rotated in mesh with the intermediate gear and having a cutting blade for cutting the ice, wherein the intermediate gear includes a second gear portion located at an outer circumferential surface of the intermediate gear and in mesh with the following gear, the second gear portion of the intermediate gear being located only at a portion of the second outer circumferential surface of the intermediate gear such that a remaining portion of the second outer circumferential surface of the intermediate gear is not in mesh with the following gear, wherein the second gear is elastically supported by an elastic member that allows the second gear to return to a cutting preparation position, wherein the elastic member is configured to allow arcuate motion of the cutting blade, and wherein a first end of the elastic member is fixed to a bracket supporting the lifting unit, and a second end of the elastic member is fixed to the cutting blade, and wherein the second gear portion of the intermediate gear rotates, in a first direction, the following gear from the cutting preparation position to cause the cutting blade of the following gear to cut ice lifted by the lifting unit and, based on rotation of the intermediate gear, relative to the following gear, reaching the remaining portion of the second outer circumferential surface of the intermediate gear that is not in mesh with the following gear, the elastic member rotates, in a second direction that is opposite of the first direction, the following gear to return the following gear to the cutting preparation position.

11. The refrigerator of claim 10, wherein the storage container is disposed such that its upper end is lower than a lower end of the ice making container.

12. The refrigerator of claim 10, wherein the ice making container widens toward an opening end of the ice making container.

13. The refrigerator of claim 10, further comprising a decelerator that is coupled to a rotational shaft of the driving motor, that is located at the lower end of the ice making container, and that is configured to decelerate a turning force of the driving motor and deliver the decelerated force to the screws.

* * * * *